United States Patent [19]

Beyer et al.

[11] 4,092,158

[45] May 30, 1978

[54] SPRAY POWDER FOR THE MANUFACTURE OF LAYERS HAVING HIGH RESISTANCE TO WEAR AND BURN TRACES

[75] Inventors: Horst Beyer; Ulrich Buran, both of Burscheid, Germany

[73] Assignee: Goetzewerke Friedrich Goetze AG, Burscheid, Germany

[21] Appl. No.: 636,224

[22] Filed: Nov. 28, 1975

[30] Foreign Application Priority Data

Nov. 28, 1974 Germany ..... 2456238

[51] Int. Cl.[2] ..... B22F 1/00

[52] U.S. Cl. ..... 75/254

[58] Field of Search ..... 75/.5 R, .5 BA, .5 C, 75/123 B, 123 J, 176, 254

[56] References Cited

U.S. PATENT DOCUMENTS

| | | | |
|---|---|---|---|
| 2,754,200 | 7/1956 | Cape | 75/123 B |
| 3,025,182 | 3/1962 | Schrewelius | 75/176 |
| 3,227,544 | 1/1966 | Rowady | 75/.5 BA |
| 3,322,546 | 5/1967 | Tanzman et al. | 75/.5 R |
| 3,666,436 | 5/1972 | Bredzs et al. | 75/.5 R |
| 3,690,686 | 9/1972 | Prasse et al. | 75/.5 R |
| 3,700,427 | 10/1972 | Hoppin et al. | 75/.5 R |
| 3,778,254 | 12/1973 | Cole et al. | 75/123 B |

*Primary Examiner*—W. Stallard

*Attorney, Agent, or Firm*—Spencer & Kaye

[57] ABSTRACT

A spray powder is provided for the manufacture of layers having a high resistance to wear and burn traces on the bearing surfaces of engine parts which are subject to friction. The spray powder consists essentially of a powder mixture of about 30 to about 80 weight percent iron, about 0.1 to about 60 weight percent of at least one Group VIB metal selected from the group consisting of molybdenum and tungsten, and about 4 to about 50 weight percent boron.

15 Claims, No Drawings

SPRAY POWDER FOR THE MANUFACTURE OF LAYERS HAVING HIGH RESISTANCE TO WEAR AND BURN TRACES

BACKGROUND OF THE INVENTION

The present invention relates to a spray powder for the manufacture of layers having a high resistance to wear and burn traces to be used as coatings on the bearing surfaces of engine parts subject to friction, and more particularly, to a spray powder for forming a coating for the bearing surfaces of piston rings used in medium and large piston engines for operation with heavy lubricants.

Piston rings of internal-combustion engines are subjected to high wear and heat stresses during operation. Therefore, in the past, the bearing surfaces of piston rings have been coated with protective coatings according to known prior art processes. Such coatings have mainly consisted of electrochemically applied hard chromium layers or molybdenum layers which are applied by thermal spray processes. However, with medium and large piston engines which operate with heavy lubricants, it happens again and again that the engines fail because of excess piston ring wear. Further, the manufacturers of such engines have increased average pressures and numbers of revolutions, and this has given rise to additional difficulties because of the formation of burn traces in the starting phase or after a short period of operation, respectively.

Attempts have therefore been made to electrochemically apply thicker chromium layers to the bearing surfaces of the piston rings. The high inherent stresses of such coatings, however, produce macrocracks and these again, under dynamic stresses, result in permanent breaks and thus loss of the rings.

Experiments have been made with thermally applied sprayed layers. However, piston rings usually employed in an engine and sprayed with molybdenum completely failed due to their low wear resistance. More favorable results have been obtained with known layers based on a mixture of molybdenum and chromium carbide, which mixture is applied by a plasma spraying process. Although wear resistance was satisfactory here, the burn trace behavior was not.

SUMMARY OF THE INVENTION

It is therefore a primary object of the present invention to provide a spray powder as a coating material for the bearing surfaces of piston rings, which powder imparts good burn trace resistance and wear resistance. A further object of this invention is to provide a spray powder as a coating material for the bearing surfaces of piston rings for medium and large piston engines which are subject to heavy stresses.

Additional objects and advantages of the present invention will be set forth in part in the description which follows and in part will be obvious from the description or can be learned by practice of the invention. The objects and advantages are achieved by means of the processes, instrumentalities and combinations particularly pointed out in the appended claims.

To achieve the foregoing objects and in accordance with its purposes, as embodied and broadly described, the present invention provides a spray powder consisting essentially of a powder mixture of about 30 to about 80 weight percent iron, about 0.1 to about 60 percent by weight of at least one Group VIB metal selected from the group consisting of molybdenum and tungsten, and about 4 to about 50 percent by weight boron.

It has been found that the proportion of the Group VIB metals, molybdenum and tungsten, in the spray powder must be varied depending on the intended use of the piston rings for engines with high or low average pressure or high or low number of revolutions, respectively. Our experiments have shown that, for slow-speed engines with rpm of less than 600, an almost pure iron-boron coating is sufficient, while for fast running engines with rpm of more than 2,000, a high total amount of Group VIB metal of molybdenum and/or tungsten is necessary to avoid the formation of burn traces.

It is to be understood that both the foregoing general description and the following detailed description are exemplary, but are not restrictive of the invention.

DETAILED DESCRIPTION OF THE INVENTION

The spray powder of the present invention contains as a first component iron in an amount of from about 30 to about 80 percent by weight. The iron in the spray powder can contain the usual residual impurities normally associated with iron in ordinary amounts.

The spray powder of the present invention contains as a second component from about 0.1 to about 60 percent by weight of at least one Group VIB metal selected from the group consisting of molybdenum and tungsten. Thus, the spray powder of the present invention can contain tungsten powder, molybdenum powder, a mixture of tungsten powder and molybdenum powder, or an alloy of tungsten and molybdenum in powder form. When a mixture or an alloy of tungsten and molybdenum powders is used, the weight percent of each metal in the mixture or alloy may vary from 0 to 100, but it is preferred to use mixtures containing 50 to 100 weight percent molybdenum, with the remainder tungsten. The average particle size of the tungsten and molybdenum powders that are used in the spray powder of the present invention can be between about 2 to 150 $\mu$m, preferably between about 5 to 45 $\mu$m. The final spray powder with its various constituents also preferably has this average particle size.

The total amount of the Group VIB metal molybdenum and/or tungsten in the spray powder can range from about 0.1 to about 60 percent, and generally depends on the particular use. When the spray powder is used to form coatings on piston rings for engines with a low number of revolutions, such as those having an rpm of less than 600, the spray powder generally should contain about 0.1 to about 30 weight percent of the Group VIB metal molybdenum and/or tungsten, and preferably, contains 0.1 to 15 weight percent of this component. When the spray powder is used to form coatings on piston rings for engines with a high number of revolutions, such as those having an rpm of more than 2,000, the spray powder generally should contain 25 to 60 weight percent of the Group VIB metal molybdenum and/or tungsten, and preferably, contains 30 to 50 weight percent of this component. When the spray powder is used to form coatings on piston rings for engines with a number of revolutions between 600 rpm and 2,000 rpm, the spray powder can contain intermediate amounts of the Group VIB metal molybdenum and/or tungsten.

The spray powder of the present invention contains boron as a third component. The amount of boron in the spray powder can range from about 4 to about 50 weight percent, and preferably, ranges from 4 to 25 weight percent. The boron in the spray powder mixture can be in the form of elemental boron, or can be either wholly or in part in the form of ferroboron and/or molybdenum boride.

The powder mixture of the present invention can comprise a mixture of the individual elements each present as a powder. Thus, molybdenum powder, iron powder and boron powder can be mixed together to form the powder mixture. Particularly good wear and burn trace resistance is obtained, however, if the spray powder, instead of being a powder mixture of the individual elements, is a mixture containing an alloy or a compound of two of the three components with each other. For example, a mixture of ferroboron and molybdenum powder within the given limits provides particularly good wear and burn trace resistance. Other spray powder mixtures are just as effective, such as, for example, a spray powder mixture of ferroboron and molybdenum boride, a spray powder mixture of molybdenum boride and iron, and a spray powder mixture of ferroboron and ferromolybdenum. The molybdenum borides which preferably are used are MoB and/or $MoB_2$.

The wear behavior of the coating layers of the present invention is further improved if the spray powder mixture contains at least one of the gases oxygen, nitrogen or hydrogen before the powder is sprayed onto the piston rings. A content of 0.5 to 8.0 percent by weight oxygen, 0.005 to 0.5 percent by weight nitrogen, and 0.01 to 0.5 percent by weight hydrogen, each partially in solution, has been found to be particularly suitable. Further, from 0.1 up to 9.0 percent by weight carbon may be present in the spray powder to make the resulting coating harder and give to it better lubrication properties. The enriching of the spray powder with the elements $O_2$, $N_2$ or $H_2$ can be effected by thermally spraying the completely mixed spray powder into an atmosphere containing the appropriate gases before the powder is thermally sprayed onto the piston rings. The carbon content of the spray powder can be produced by spraying the spray powder into a hydrocarbon gas. By setting the partial pressures of the gases in the spray chamber, it is possible to directly adjust the gas content in the powder mixture and obtain a desired gas content.

Only one of the elements oxygen, nitrogen, hydrogen or carbon can be provided in the spray or welding powder, or any combination of two or more of these elements can be provided, including all four elements.

When oxygen is present in the welding powder, the oxygen content of the welding powder is between about 0.001 and about 12 percent by weight, preferably 3.9 to 4.5 percent by weight, based on the weight of the welding powder. Generally, at least 1 weight percent of this oxygen is unbound, and the welding powder contains from about 0.00001 to about 0.12 weight percent, preferably 0.039 to 0.045 weight percent, unbound oxygen.

When nitrogen is present in the welding powder, the nitrogen content of the welding powder is between about 0.001 to about 0.5 percent by weight, preferably 0.003 to 0.006 percent by weight, based on the weight of the welding powder. Generally, at least 1 weight percent of this nitrogen is unbound, and the welding powder contains from about 0.00001 to about 0.005 weight percent, preferably 0.00003 to 0.00006 weight percent, unbound nitrogen.

When hydrogen is present in the welding powder, the hydrogen content of the welding powder is between about 0.001 and about 0.5 percent by weight, preferably 0.003 to 0.01 percent by weight, based on the weight of the welding powder. Generally, at least 1 weight percent of this hydrogen is unbound, and the welding powder contains from about 0.00001 to about 0.005 weight percent, preferably 0.00003 to 0.0001 weight percent, unbound hydrogen.

When carbon is present in the welding powder, the carbon content of the welding powder is between about 0.01 and about 2.5 percent by weight, preferably 0.1 to 1.5 percent by weight, based on the weight of the welding powder. Generally, at least 30 weight percent of this carbon is unbound, and the welding powder contains from about 0.003 to about 0.8 weight percent, preferably 0.03 to 0.5 weight percent, unbound carbon.

The wear resistance of the layer or deposit formed by the spray powder can be significantly increased if the spray powder contains at least one other element which can form mixed carbides with the molybdenum and/or tungsten present in the powder. Thus, one or more carbide-forming materials comprising at least one material selected from the group consisting of nickel, cobalt, titanium, vanadium, chromium, aluminum, tantalum, rhenium and zirconium can be present in the spray powder. These carbide-forming materials can be added to the spray powder as individual metallic elements or can be added in the form of alloys, such as alloys with each other, or with the molybdenum or tungsten in the spray powder. The total amount of these carbide-forming elements, either singly or in combination, which may be contained in the spray powder can be up to about 35 percent by weight of the spray powder, preferably 0.1 to 25 percent by weight. During the spray process, the carbide-forming elements are converted to carbides which contribute to the wear resistance of the spray deposit. The carbon required for this carbide formation may be obtained from materials providing carbon. For example, iron carbide can be added to the spray powder to provide the necessary carbon for the carbide formation. Similarly, carbon can be added to the spray powder to provide the necessary carbon for carbide formation. Further, the base material on which the spray powder is deposited, that is, the material which is protected by the spray deposit, can provide the necessary carbon for the carbide formation. For example, cast iron often is the base or parent material on which the spray deposit is formed, and this base material can provide the necessary carbon for the carbide formation.

In the case of depositing such a layer onto a base material containing no carbon, then carbon must initially be added to the powder mixture either in the form of fine graphite or carbon-containing compounds. The content of carbon for this purpose is preferably between 0.1 to 1.5 percent by weight.

When the spray powder contains these carbide-forming materials, they replace part of the molybdenum and tungsten in the spray powder so that the total molybdenum and tungsten content of such a spray powder generally ranges from about 0.1 to about 25 weight percent. Generally, no more than 60 percent by weight of the molybdenum and tungsten should be replaced by these elements.

The iron in the spray powder can also serve as a carbide-forming material.

The following examples are given by way of illustration to further explain the principles of the invention. These examples are merely illustrative and are not to be understood as limiting the scope and underlying principles of the invention in any way. All percentages referred to herein are by weight unless otherwise indicated.

EXAMPLE 1

A piston ring for slow speed combustion engines with rpm of about 600 is coated by plasma spraying a powder mixture of 85% Ferrobor (14.7% boron, 82.2% iron, 1.3% aluminum, 0.3% silicon and impurities the remainder)
10% of a nickel-chromium alloy (80% Ni, 20% Cr)
5% molybdenum (99.9%)

EXAMPLE 2

A piston ring for combustion engines with speeds of about 1,500 rpm is coated by plasma spraying a powder mixture of 70% Ferrobor (quality of example 1)
30% molybdenum-titan alloy with 85% Mo and 15% titanium

EXAMPLE 3

A piston ring for high speed combustion engines with rpm of more than 2,000 is coated by plasma spraying a powder mixture of 50% Ferrobor (quality of example 1)
50% Molybdenum (99.9%)

The thus-coated piston rings of the examples 1 to 3 showed in test runnings good burn trace and wear resistance.

It will be understood that the above description of the present invention is susceptible to various modifications, changes and adaptations, and the same are intended to be comprehended within the meaning and range of equivalents of the appended claims.

What is claimed is:

1. In a spray powder for the manufacture of a coating having a high resistance to wear and burn traces on the bearing surface of an engine part which is subject to friction, the improvement wherein the spray powder consists essentially of a powder mixture of about 30 to about 80 weight percent iron, about 0.1 to about 60 weight percent of at least one Group VIB metal selected from the group consisting of molybdenum and tungsten, and about 7.35 to about 50 weight percent boron.

2. Spray powder as defined in claim 1, wherein the quantity of said Group VIB metal in the spray powder is low for coatings intended for piston rings for engines with a low number of revolutions of less than 600 rpm.

3. Spray powder as defined in claim 2, wherein the quantity of said Group VIB metal is between 0.1 and 30 weight percent.

4. Spray powder as defined in claim 1, wherein the quantity of said Group VIB metal in the spray powder is high for the manufacture of coatings on piston rings for engines with a high number of revolutions greater than 2,000 rpm.

5. Spray powder as defined in claim 4, wherein the quantity of said Group VIB metal is between 25 and 60 weight percent.

6. Spray powder as defined in claim 1, wherein boron is present in the powder mixture in the form of ferroboron.

7. Spray powder as defined in claim 1, wherein boron is present in the powder mixture in the form of molybdenum boride.

8. Spray powder as defined in claim 1, wherein the powder contains at least one of the elements oxygen, nitrogen, carbon and hydrogen, partially in dissolved form, and when oxygen is present in the spray powder, it is present in an amount of about 0.001 to about 12 percent by weight, with the free oxygen content being from about 0.00001 to about 0.12 weight percent;

when nitrogen is present in the spray powder, it is present in an amount of about 0.001 to about 0.5 percent by weight, with the free nitrogen content being from about 0.00001 to about 0.005 weight percent;

when hydrogen is present in the spray powder, it is present in an amount of about 0.001 to about 0.5 percent by weight, with the free hydrogen content being from about 0.00001 to about 0.005 weight percent; and when carbon is present in the spray powder, it is present in an amount of about 0.01 to about 2.5 percent by weight, with the free carbon content being from about 0.003 to about 0.8 weight percent.

9. Spray powder as defined in claim 1, wherein the powder contains from about 0.1 to about 9 weight percent carbon.

10. Spray powder as defined in claim 1, which contains at least one carbide-forming element of nickel, cobalt, titanium, vanadium, chromium, aluminum, tantalum, rhenium, zirconium, and alloys thereof.

11. The spray powder as defined in claim 10, wherein the amount of said carbide-forming element is from about 0.1 to about 35 weight percent.

12. The spray powder as defined in claim 1, wherein the powder contains about 12.5 to about 50 weight percent boron.

13. The spray powder as defined in claim 1, wherein the powder contains about 25 to about 50 weight percent boron.

14. The spray powder as defined in claim 1, wherein said Group VIB metal is molybdenum.

15. The spray powder as defined in claim 1, wherein the powder contains about 7.35 to about 25 weight percent boron.

* * * * *